US005327769A

United States Patent [19]

Price

[11] Patent Number: 5,327,769

[45] Date of Patent: Jul. 12, 1994

[54] APPARATUS FOR STRAIGHTENING RAIL CAR HANDHOLD SAFETY APPLIANCES

[76] Inventor: Bobby Price, Rte. 3, Box 44-B, Terry, Miss. 39170

[21] Appl. No.: 819,628

[22] Filed: Jan. 10, 1992

Related U.S. Application Data

[63] Continuation-in-part of Ser. No. 506,287, Apr. 9, 1990, abandoned.

[51] Int. Cl.[5] ..... B21D 3/16

[52] U.S. Cl. ..... 72/458; 72/211; 72/215; 72/217; 72/219

[58] Field of Search ..... 72/211, 214, 215, 216, 72/217, 218, 219, 411, 467, 458, 459, 479, 705

[56] References Cited

U.S. PATENT DOCUMENTS

| | | | |
|---|---|---|---|
| 859,706 | 7/1907 | Swaney | 72/458 |
| 1,136,252 | 4/1915 | Meier | 72/219 |
| 1,284,516 | 11/1918 | Whitecotton | 72/217 |
| 1,642,657 | 9/1927 | Frick | 72/219 |
| 2,440,536 | 4/1948 | Begley | 72/215 |
| 2,502,713 | 4/1950 | Fagge | 72/388 |
| 2,675,723 | 4/1954 | Stein | 72/458 |

FOREIGN PATENT DOCUMENTS

| | | | |
|---|---|---|---|
| 438952 | 1/1912 | France | 72/458 |
| 47790 | 9/1920 | Sweden | 72/459 |
| 755244 | 8/1956 | United Kingdom | 72/211 |

*Primary Examiner*—David Jones

[57] ABSTRACT

This invention is an apparatus for straightening handhold safety appliances located on the side of rail cars.

1 Claim, 2 Drawing Sheets

APPARATUS FOR STRAIGHTENING RAIL CAR HANDHOLD SAFETY APPLIANCES

This application is a continuation in part of my copending application Ser. No. 07/506,287, filed Apr. 9, 1990, now abandoned.

BACKGROUND OF THE INVENTION

This invention relates generally to a hand tool which serves as a tube straightening apparatus. More specifically, the apparatus is used to straighten handhold safety appliances which are located on the sides of rail cars.

Although the prior art is replete with devices for straightening tubes and bars, there is an absence of devices capable of easily and quickly straightening railroad car safety appliances. Up until the present time, no one has developed a simple, efficient, light-weight apparatus which straightens handhold safety appliances and insures that a handhold maintains its required clearance from the side of the rail car.

SUMMARY OF THE INVENTION

Title 49, part 231 of the Code of Federal Regulations governs railroad safety appliance standards. Section 231.1 requires that a handhold maintain a minimum clearance of two, preferably two and one-half inches, from the railroad car.

Typically, handholds are constructed of wrought-iron or steel and are riveted to the sides of rail cars. During normal use and operation of rail cars, the handhold safety appliances are often bent or damaged in such a manner that the required minimum clearance is not maintained.

When this occurs, the rail car is removed from service resulting in unnecessary down-time while the bent handhold is fixed. For example, a rail car is removed from service and transported to a shop facility. There, the handhold is cut off and replaced with a straight handhold. The car is then returned to service two or three days after being removed from service.

The present invention is designed so that when a bent handhold is identified, the invention is releaseably attached to the handhold. A force is then applied to the handle of the invention, thereby pulling the handhold away from the body of the rail car and straightening it so that it will maintain a two to two and one-half inch clearance from the rail car. This simple process of straightening handholds saves much down-time. Also, the invention provides an easy means of determining whether rail car handholds are in compliance with federal regulations.

An object of the present invention is to provide a simple, efficient, light-weight device for straightening rail car handhold safety appliances.

Another object of the present invention is to provide a device for straightening rail car handholds without removing the handhold from the rail car.

Yet another object of the invention is to provide a device which will pull a handhold safety appliance a pre-set distance from the rail car.

It is also an object of the present invention to provide its user with a simply way of determining the total clearance from the handhold to the rail car.

An object of the invention is to also utilize a rolling fulcrum.

These and other objects will become apparent from a detailed description that follows when viewed in conjunction with the accompanying drawings.

DETAILED DESCRIPTION OF THE PREFERRED EMBODIMENTS

Figure 1:
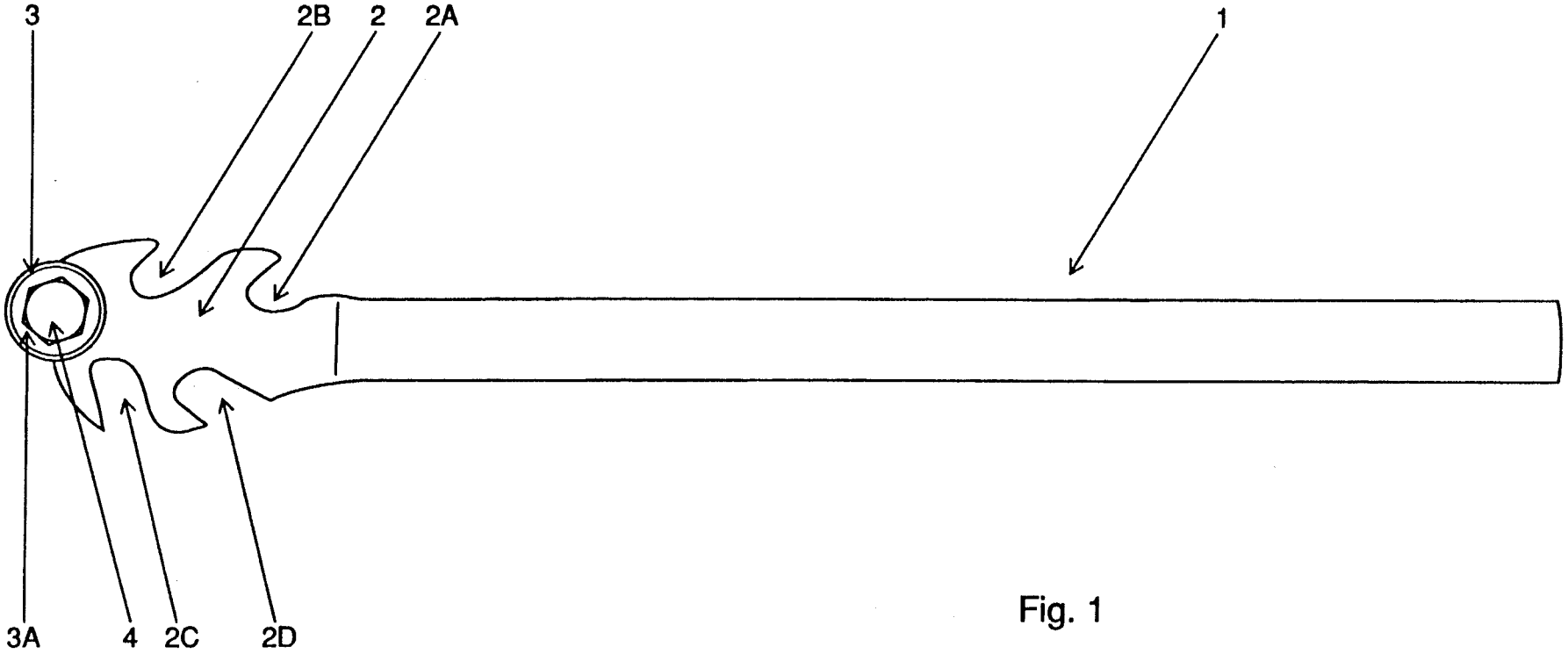
FIG. 1 is a side view of the invention. This side view is the same for both sides of he invention.

As can be seen by reference to FIG. 1, the invention consists of a handle 1; a body 2 having a multiplicity of c-shaped hooks 2*a*, 2*b*, 2*c* and 2*d*; and a roller 3*a* on each side of the body 2, whereby said rollers serve as a fulcrum roller. Said rollers 3*a* are connected to said body 2 by a fastener or bolt 4 so that when the rollers 3*a* are stationary, the handle 1 and body 2 will rotate around said bolt 4. Each side view of the invention is identical as shown in FIG. 1 and FIG. 2.

It should be noted that the base of each c-hook 2*a*, 2*b*, 2*c* and 2*d* is a specific distance from the outermost edge 3 of the rollers 3*a*. These distances usually vary from two to two and one-half inches so that once the handhold 5 is pulled away from the rail car 6 the handhold will be in compliance with federal regulations regarding minimum clearance.

Figure 2:
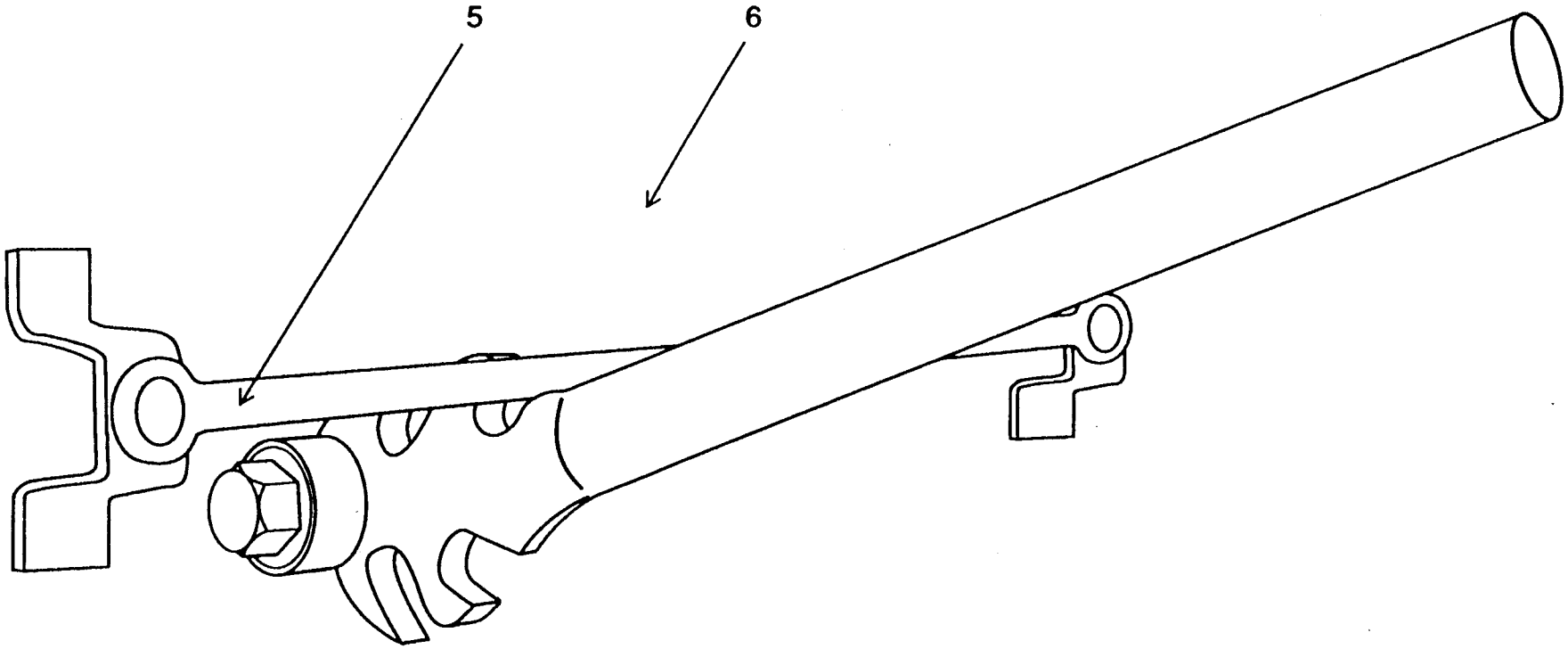
FIG. 2 is a side perspective of the invention in use. This persepctive of the invention is the same for both sides of the invention.

When it is desired to straighten a handhold safety appliance 5 as shown in FIG. 2, the force applied to the handle 1 will be transferred through the rollers 3*a* and against the wall of the rail car 6 so that when one of the c-shaped hooks 2*a*, 2*b*, 2*c* or 2*d* engages the handhold 5, said handhold will be pulled away from the rail car. It is important to note that as the downward force is applied to the handle 1, the rollers 3*a* will turn thereby allowing the body 2 to move upwardly as the handhold 5 is pulled away from the rail car 6. Thus, when the handle 1 is perpendicular to the plane of the rail car 6, the handhold 5 is the desired distance from the rail car 6.

When the invention is being used, the rolling action of the rollers 3*a* results in the location of the pivot point being the point where a c-shaped hook engages the handhold 5. The force to be applied to a handhold is, therefore, variable depending on which c-hook is used. Additionally, friction is reduced by the rolling motion of the rollers.

This process can be repeated as often as necessary in order to straighten handhold safety appliances or to simply determine whether a particular handhold is in compliance with federal railroad safety appliance standards.

Although particular components have been discussed with the specific embodiment of the invention, other components may be utilized in accordance with the teachings of the present invention. Furthermore, it is understood that although an exemplary embodiment of the invention has been disclosed, other applications and mechanical arrangements are possible and the embodiment disclosed may be subjected to various changes, modifications and substitutes without departing from the spirit of the invention.

What I claim is:

1. An apparatus for straightening rail car handhold safety appliances comprising:

a handle;

a body having opposite sides attached to one end of said handle, said body having a multiplicity of open ended c-hooks, said c-hooks being open-ended in a direction of said handle and each of said c-hooks being releaseably engageable with a rail car handhold safety appliance; and a plurality of rollers attached to said body on said opposite sides thereof, whereby said rollers are in contact with an outer wall of a railcar when a c-hook engages said rail car handhold safety appliance.

* * * * *